US008453953B2

(12) United States Patent
French et al.

(10) Patent No.: US 8,453,953 B2
(45) **Date of Patent: *Jun. 4, 2013**

(54) METHOD TO TRANSFORM BULK MATERIAL

(75) Inventors: Robert R. French, Wellington, CO (US); Robert A. Reeves, Arvada, CO (US)

(73) Assignee: GTL Energy Holdings Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/046,448

(22) Filed: Mar. 11, 2011

(65) Prior Publication Data

US 2011/0167715 A1 Jul. 14, 2011

Related U.S. Application Data

(63) Continuation of application No. 11/380,884, filed on Apr. 28, 2006, now Pat. No. 7,913,939.

(60) Provisional application No. 60/676,621, filed on Apr. 29, 2005.

(51) Int. Cl.
*B02C 19/00* (2006.01)

(52) U.S. Cl.
USPC ..... 241/3; 241/19; 241/29

(58) Field of Classification Search
USPC ..... 241/3, 19, 29, 101.4
See application file for complete search history.

(56) References Cited

U.S. PATENT DOCUMENTS

| | | | |
|---|---|---|---|
| 286,520 | A | 10/1883 | Andrus |
| 2,610,115 | A | 9/1952 | Lykken |
| 3,114,930 | A | 12/1963 | Oldham et al. |
| 3,506,200 | A | 4/1970 | Raudenbush et al. |
| 3,619,376 | A | 11/1971 | Patel et al. |
| 3,643,873 | A | 2/1972 | George |
| 3,822,827 | A | 7/1974 | Clark |
| 3,996,026 | A | 12/1976 | Cole et al. |

(Continued)

FOREIGN PATENT DOCUMENTS

| | | |
|---|---|---|
| CA | 1145699 | 5/1983 |
| CA | 1213844 | 11/1986 |

(Continued)

OTHER PUBLICATIONS

International Search Report for International (PCT) Patent Application No. PCT/US06/16319, mailed Aug. 12, 2008.

(Continued)

*Primary Examiner* — Mark Rosenbaum
(74) *Attorney, Agent, or Firm* — Sheridan Ross P.C.

(57) ABSTRACT

The invention provides low-cost, non-thermal methods to transform and beneficiate bulk materials, including low rank coals such as peat, lignite, brown coal, subbituminous coal, other carbonaceous solids or derived feedstock. High pressure compaction and comminution processes are linked to transform the solid materials by eliminating interstitial, capillary, pores, or other voids that are present in the materials and that may contain liquid, air or gases that are detrimental to the quality and performance of the bulk materials, thereby beneficiating the bulk products to provide premium feedstock for industrial or commercial uses, such as electric power generation, gasification, liquefaction, and carbon activation. The handling characteristics, dust mitigation aspects and combustion emissions of the products may also be improved.

20 Claims, 2 Drawing Sheets

U.S. PATENT DOCUMENTS

| | | | | |
|---|---|---|---|---|
| 4,047,898 | A | 9/1977 | Cole et al. | |
| 4,057,399 | A | 11/1977 | Cole et al. | |
| 4,104,035 | A | 8/1978 | Cole et al. | |
| 4,166,802 | A | 9/1979 | Slater et al. | |
| 4,212,112 | A | 7/1980 | LaDelfa et al. | |
| 4,223,449 | A | 9/1980 | Bodle et al. | |
| 4,224,039 | A | 9/1980 | Smith et al. | |
| 4,225,391 | A | 9/1980 | Perch et al. | |
| 4,304,572 | A | 12/1981 | Wiese et al. | |
| 4,309,109 | A | 1/1982 | Blodgett et al. | |
| 4,309,190 | A | 1/1982 | Baron et al. | |
| 4,372,749 | A | 2/1983 | Nielsen | |
| 4,508,539 | A | 4/1985 | Nakai | |
| 4,533,460 | A | 8/1985 | Ho | |
| 4,726,531 | A | 2/1988 | Strasser | |
| 4,782,747 | A | 11/1988 | Unger et al. | |
| 5,005,770 | A | 4/1991 | Suessegger | |
| 5,067,968 | A | 11/1991 | Davidson et al. | |
| 5,125,931 | A | 6/1992 | Schulz | |
| 5,251,824 | A | 10/1993 | Adelmann | |
| 5,361,513 | A | 11/1994 | Woessner | |
| 5,462,425 | A | 10/1995 | Kuss et al. | |
| 5,509,612 | A | 4/1996 | Gerteis | |
| 5,658,357 | A | 8/1997 | Liu et al. | |
| 5,667,642 | A | 9/1997 | Luthi | |
| 5,725,613 | A | 3/1998 | Reeves et al. | |
| 5,752,993 | A | 5/1998 | Eatough et al. | |
| 5,862,746 | A | 1/1999 | Bielfeldt | |
| 5,876,648 | A | 3/1999 | Strasser et al. | |
| 5,902,456 | A | 5/1999 | Sundqvist et al. | |
| 6,054,074 | A | 4/2000 | Wu et al. | |
| 6,148,599 | A | 11/2000 | McIntosh et al. | |
| 6,311,849 | B1 | 11/2001 | Sbaschnigg et al. | |
| 6,338,305 | B1 | 1/2002 | McHenry et al. | |
| 6,461,505 | B1 | 10/2002 | Danielsson et al. | |
| 6,889,923 | B2 | 5/2005 | Gutierrez et al. | |
| 7,128,767 | B2 | 10/2006 | French et al. | |
| 7,913,939 | B2 * | 3/2011 | French et al. | 241/3 |
| 2006/0112617 | A1 | 6/2006 | Clark et al. | |
| 2006/0180525 | A1 | 8/2006 | Watters et al. | |
| 2008/0222947 | A1 | 9/2008 | French et al. | |
| 2009/0158645 | A1 | 6/2009 | French et al. | |

FOREIGN PATENT DOCUMENTS

| | | |
|---|---|---|
| CA | 2072245 | 12/1993 |
| CA | 2514525 | 8/2004 |
| CA | 2564543 | 11/2005 |
| DE | 216952 | 1/1985 |
| GB | 20679 | 1/1916 |
| GB | 05019 | 3/1916 |
| JP | 59-102989 | 6/1984 |
| JP | 06-172764 | 6/1994 |
| WO | WO 2004/072212 | 8/2004 |
| WO | WO 2005/028977 | 3/2005 |
| WO | WO 2006/119044 | 11/2006 |

OTHER PUBLICATIONS

Written Opinion for International (PCT) Patent Application No. PCT/US06/16319, mailed Aug. 12, 2008.

International Preliminary Report on Patentability for International (PCT) Patent Application No. PCT/US06/16319, mailed Mar. 19, 2009.

Examiner's First Report for Australian Patent Application No. 2006-242458, mailed Dec. 11, 2009.

Notice of Acceptance for Australian Patent Application No. 2006242458, dated Jan. 6, 2011.

Examiner's First Report for Canadian Patent Application No. 2606023, mailed Apr. 29, 2010.

Examination Report for New Zealand Patent Application No. 562623, mailed Sep. 7, 2009.

Office Action for U.S. Appl. No. 11/380,884, mailed Nov. 5, 2008.

Office Action for U.S. Appl. No. 11/380,884, mailed Jun. 12, 2009.

Office Action for U.S. Appl. No. 11/380,884, mailed Sep. 25, 2009.

Office Action for U.S. Appl. No. 11/380,884, mailed Mar. 11, 2010.

Office Action for U.S. Appl. No. 11/380,884, mailed Jun. 24, 2010.

Office Action for U.S. Appl. No. 11/380,884, mailed Dec. 17, 2010.

Notice of Allowance for U.S. Appl. No. 11/380,884, mailed Feb. 10, 2011.

Anagnostopoulos, "Compressibility Behaviour of Soft Lignite," Journal of Geotechnical Engineering Division, Dec. 1982, vol. 108, No. 12, pp. 1549-1566.

Brockway, "Mechanical Thermal Expression of High Moisture Lignite," 18th International Low Rank Fuels Symposium, Billings, Montana, Jun. 2003, 8 pages.

Bullinger, "Lignite Fuel Enhancement," 18th International Low-Rank Fuels Symposium, Billings, Montana, Jun. 2003, 12 pages.

Cengiz Akdeniz et al., "Cotton Stalk as a Potential Energy Source," Energy Sources, Part A: Recovery, Utilization, and Environmental Effects, 2004, vol. 26(1), pp. 65-75.

Couch, "Lignite Upgrading," International Energy Agency Coal Research, London, UK, May 1990, pp. 1-72.

Durie, "Science of Victorian Brown Coal: Structure, Properties, and Consequences for Utilization," CSIRO, Division Coal and Energy Technology, 1991, 737 pages, Melbourne, Australia.

Mani et al., "Economics of Producing Fuel Pellets from Biomass," Applied Engineering in Agriculture, 2006, vol. 22(3), pp. 421-426.

Official Action for Canadian Patent Application No. 2,606,023, dated Mar. 28, 2011.

Examination Report for New Zealand Patent Application No. 590973, dated Feb. 9, 2011.

Examination Report for New Zealand Patent Application No. 590973, dated Nov. 14, 2011.

Official Action for Australia Patent Application No. 2011201612, dated Nov. 21, 2011.

Supplementary European Search Report for European Patent Application No. EP06751810, dated Nov. 24, 2011.

Official Action for European Patent Application No. 06751810, dated Jan. 10, 2012.

Notice of Acceptance for Indonesian Patent Application No. HKI.3-H1-05.01.04 2029, mailed Mar. 26, 2012, 4 pages (with English translation).

Examination Report for New Zealand Patent Application No. 590973, dated May 9, 2012, 2 pages.

Official Action for New Zealand Patent Application No. 590973, dated Jul. 12, 2012, 2 pages.

Official Action for Canadian Patent Application No. 2,787,999, mailed Oct. 9, 2012, 4 pages.

Notice of Acceptance for New Zealand Patent Application No. 590973, dated Nov. 26, 2012, 1 page.

* cited by examiner

METHOD TO TRANSFORM BULK MATERIAL

CROSS REFERENCE TO RELATED APPLICATION

This application is a Continuation of U.S. patent application Ser. No. 11/380,884 filed Apr. 28, 2006, now U.S. Pat. No. 7,913,939, which claims priority under 35 U.S.C. §119 (e) to U.S. Provisional Patent Application Ser. No. 60/676,621 filed Apr. 29, 2005, all applications being incorporated herein in their entirety by this reference.

FIELD OF THE INVENTION

This invention provides low-cost, non-thermal methods to transform and beneficiate bulk materials, including low rank coals, to provide premium feedstock for industrial or commercial uses.

BACKGROUND OF THE INVENTION

Low Rank Coals (LRC) comprise almost 50% of total coal production in the United States, and about one-third of the coal produced worldwide. LRCs are characterized by their high levels of porosity and their water content which is retained in three basic forms: interstitial, capillary and bonded. Removal of the voids in which air, gas, and water reside in these coals requires primary comminution followed by compaction and higher energy inputs as transformation becomes more rigorous. The excess constituents, including air, gas, and water that would otherwise dilute the combustible material, are progressively expelled as interstitial voids between particles, and pores contained in the particles are eliminated.

The utility and gasification industries have long recognized the benefits of reducing these constituents in coal. Numerous beneficiation systems of varied technical complexity have been designed, but almost all use some form of thermal energy such as flue gas, steam, hot oil, hot water or the like, to remove water and some organic material (see, Davy-McKee, Inc. *Comparison of Technologies for Brown Coal Drying*, Coal Corporation of Victoria, Melbourne Australia (1984)). The technical, economic and environmental benefits realized by the use of these thermal drying procedures have been well documented and include increased power plant efficiency, increased generating efficiency, reduced greenhouse gas emissions, reduced dependence on carbon dioxide disposal systems, increased value of the LRC resources and reduced parasitic power consumption. But while these thermal beneficiation systems are technically effective, they are also expensive to build, costly to operate, site restricted, and must compete with other market opportunities for the energy they consume.

Additionally, thermal drying can produce coal dust that leads to unacceptably dangerous fuel products. High temperature thermal drying of coal, especially LRCs, largely alters the chemical characteristics of the fuel. The dried product is more reactive to air and may rapidly rehydrate, thus providing greater opportunity for spontaneous combustion and catastrophic fires. High volumes of coal fines and dust associated with thermally dried LRC create handling problems and product losses during rail transportation and handling, and some thermal drying systems are unable to process LRC fines of less than one-quarter inch and require alternative processing or result in substantial waste.

Thus, new coal benefication techniques are needed that can realize the substantial benefits of drying LRCs without the economic disincentives and production hazards associated with thermal drying techniques.

SUMMARY OF THE INVENTION

This invention provides new beneficiation methods that can be applied to transform a wide range of bulk materials and that does not use thermal energy or adversely alter the chemical nature of these materials. This methodology takes advantage of the fact that most of the gas and water is held in microscopic voids in the structure of the bulk materials and especially in low rank coals (LRCs). Comminution and high compaction forces are applied to transform the structure of these bulk materials by destroying most of the internal voids to release the air, gas, and liquids and preventing their recapture by sorption. By reducing or destroying these voids, this methodology produces a dense, compact, solid material. In the case of coal transformation this methodology produces a fuel with higher energy and fewer deleterious components. The end products of these techniques may be customized for the mining, transportation and consumer industries.

The methods and apparatus disclosed herein exert extreme compaction forces on prepared LRC feedstocks in order to destroy the interstitial, capillary, pores and other voids, thus transforming the physical characteristics of LRC and other similar bulk materials. Air and gas are expelled and water is transferred to the surfaces of the LRC particles where it is removed by mechanical means or during pneumatic transfer to produce clean and compact final products.

Unlike many expensive batch processes that use thermal energy and low compaction forces to heat and squeeze the coal, the present invention uses no thermal energy and operates in a continuous mode. These continuous processes result in higher throughputs than batch processing, significantly lower operating costs as no thermal energy is required, and greater safety as no external heat is applied. Additionally, the products formed are more stable as minimal rehydration of the dried products takes place and therefore less dust and fines are generated compared to thermal drying techniques. The environmental impact of high temperature drying techniques are substantially reduced by the processes disclosed herein because the organic rich effluents that are produced by thermal drying are minimized or eliminated by the techniques of the present invention.

These inventive processes include compaction and comminution of the bulk coal feed material, and multiple stages of compaction and comminution can be used to achieve the desired heat content for either existing or new coal-fired projects. The products can then be agglomerated to a suitable top size for transportation or alternate uses.

In one preferred configuration, the bulk starting material is comminuted then compacted between counter-rotating rolls. In this process gases may be dissipated as internal voids within the material are destroyed, and expelled liquids are separated from the solids by mechanical removal in liquid phase from the rolls, and in gas phase during transport to a subsequent processing that may include additional cycles of comminution and compaction.

One embodiment is a method of transforming a bulk starting material including compacting a bulk material and then comminuting the compacted bulk material to form a comminuted material. The comminuted material may have fewer void spaces than the bulk starting material. The bulk material useful in these methods is composed of particles that hold gases or liquids within void spaces within the solid particles.

Typically, the bulk material is a carbonaceous material such as bituminous coal, peat, low-rank coals, brown coal, lignite and subbituminous coal or carbonaceous materials that have been pre-processed using beneficiation procedures such as thermal drying, washing, biological and chemical beneficiation, dry screening or wet screening. The bulk material may also be gypsum, coke, expandable shales, oil shale, clays, montmorillonite, and other naturally-occurring salts including trona, nacolite, borite, and phosphates. When undergoing compaction at high pressures, gases and/or liquids are forced from void spaces in the bulk material.

In one embodiment, the bulk material is first crushed or broken to an average particle top size between about 0.006 inch and about 1 inch prior to moving the bulk material to the compacting machinery. If needed, the bulk material is stored in a collection vessel, such as a surge bin, after crushing and prior to compacting, and this allows the bulk material to be fed at a controlled rate to compacting machinery. The bulk material may be frozen, chilled or heated if desired. However, the bulk material is preferably processed and stored at ambient temperature to minimize energy expenditure and processing costs and to maintain liquids and gasses in the bulk materials in a liquid or gaseous state to facilitate their removal from the bulk materials during processing.

The bulk material is subjected to a compaction pressure of at least about 3000 psi, and typically at a pressure as high as about 80,000 psi. Preferably, the bulk material is subjected to a pressure between about 20,000 psi and about 60,000 psi during compaction, and more preferably, the bulk material is subjected to a pressure of about 40,000 psi during compaction. The compaction pressure is applied for short time periods of between about 0.001 seconds and about 10 seconds.

In one embodiment, the compacting is performed by feeding the bulk material between two counter-rotating rolls aligned in proximity to one another. The compaction pressure is applied to the bulk material as the material is fed between the rolls. In this embodiment, the void spaces within the bulk materials may be crushed and eliminated from the materials as the material passes between the counter-rotating rolls forcing liquids and gases from the bulk material. These counter-rotating rolls may be cleaned with companion rollers, squeegees or blades. The counter-rotating rolls may be driven by a reducer and an electric motor at a speed that provides a bulk material residence time within the compression zone of the rollers of between about 0.001 seconds and about 10 seconds. The bulk materials of this embodiment are compressed into a ribbon that exits the rollers and breaks or fractures into large compacts.

Compressed materials are comminuted to reduce the particle size of compacts that have been produced by the high compaction pressures described above. The comminuting may include cutting, chopping, grinding, crushing, milling, micronizing and triturating the compressed materials. Preferably, the comminuting methods used can accept and process compressed materials at a rate equal to the rate at which the compacts exit the compacting machinery. If this is not convenient, the compressed materials can be collected and stored or held briefly until they are introduced to the comminuting machinery at a controlled rate. The compressed material is comminuted to an average particle top size between about 0.006 inch and about 1 inch. The comminuted material may then be dried, packaged, stored, pneumatically transferred to another facility for additional processing such as separation of solids and gases, and the like.

These processes of compacting and comminuting the bulk material may then be repeated as many times as desired to continue the transformation of the material, further eliminating void spaces and the liquids or gases therein with each successive round of compaction and comminution.

In another embodiment, the comminuted bulk material is subjected to another compression step. This second compression may be designed to specifically remove liquids from the surfaces of the materials. In this embodiment, comminuted material is compressed using compaction machinery that absorbs liquids present on the transformed materials. This compaction is preformed at a compaction pressure between about 3,000 psi and about 15,000 psi. This compaction to remove additional liquids present is conducted by contacting the comminuted material with a porous compaction surface. This porous compaction surface may absorb liquids from the comminuted materials. The separated liquids may be carried away from the materials. Preferably, this compacting is performed using counter-rotating rolls composed of porous materials. These porous counter-rotating rolls may absorb liquid into the porous material to be pulled away from the comminuted materials and collected or discharged to the environment. Liquids may be removed from the surface of the porous counter-rotating rolls with a scraper blade. Bulk material exiting the porous counter-rotating rolls may have a lower liquid content than the comminuted feed material.

Another embodiment described herein is an absorptive roll assembly that can be used in the compaction between two counter-rotating rolls to remove liquids from a bulk material. These rolls are composed of a central shaft supported by bearings at each end of the central shaft and end pieces affixed around the central shaft between the bearings. Liquid receptors are affixed around the central shaft between the end pieces. The liquid receptors contain an absorptive porous material that can wick liquid from a bulk material compressed against the porous material. The end pieces preferably contain weep holes that direct liquids absorbed in the porous rolls towards the ends of the central shaft and away from the bulk materials. Preferably, liquid receptors can be independently detached and replaced on the central shaft.

DETAILED DESCRIPTION OF THE INVENTION

Figure 1:
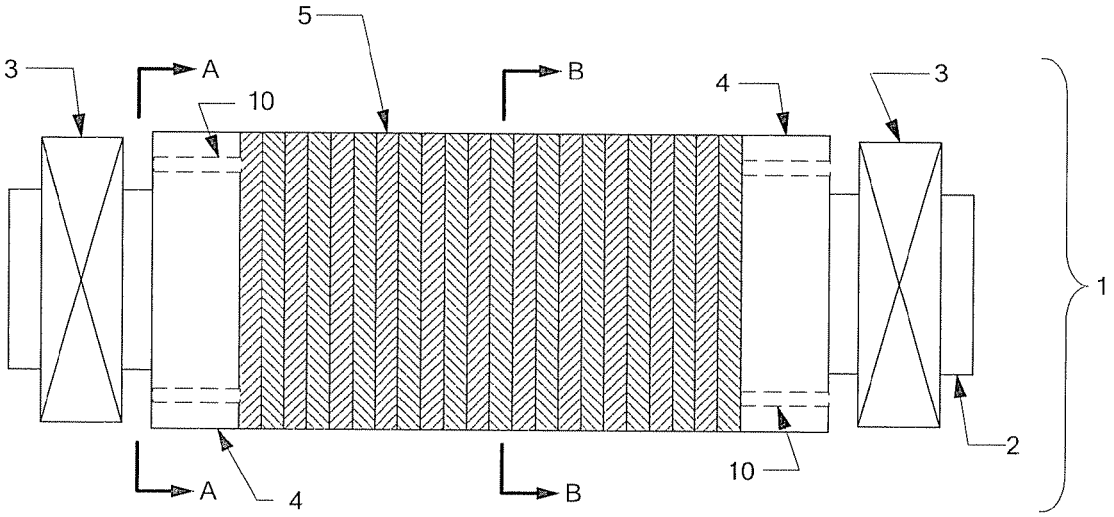
FIG. 1 shows a schematic drawing of a plan view of a single absorber roll useful in an absorptive counter-rotating roll assembly.

The present invention is drawn to a process that efficiently transforms bulk materials such as low rank coal (LRC) into economically useful feedstocks with lower environmental impact and hazards production than has previously been possible. Additionally, apparatuses useful for carrying out these transformative processes on bulk materials are described herein.

Bulk materials contain interstitial spaces between the particles of bulk material as well as capillary or pore spaces that exist within each individual bulk particle. For the purposes of this disclosure, these interstitial, capillary and pore spaces are referred to collectively as "void" space within the bulk material. The transformation processes of the present invention are performed by applying compaction and comminution forces to a bulk material sufficient to collapse and destroy these void spaces that exist within the bulk materials. These processes expel substances, including gases and liquids that reside in the void spaces from the bulk material. In these transformation processes, the substances are separated from the bulk material.

These processes include compaction and comminution of the bulk materials followed by sorption of liquids from the comminuted products. The comminuted products may then be subjected to further evaporative drying steps to complete the initial transformation of the bulk products. The transformed products may optionally be subjected to subsequent rounds of these transformation steps.

Bulk materials suitable for transformation in the processing procedures of the present invention may include any solid feed materials that hold gases or liquids within void space or on the surface of the solids. These materials may be naturally occurring carbonaceous materials including bituminous coal, peat and low-rank coals (LRCs), which include brown coal, lignite and subbituminous coal. The bulk feed material may similarly contain carbonaceous materials that have undergone prior processing such as bituminous coal, peat, and LRCs that have undergone pre-processing using thermal drying methods, washing processes, biological beneficiation methods, or other pre-treatment processes, or dry or wet screening operations. Additionally, the bulk material may be gypsum, coke, expandable shales, oil shale, clays, montmorillonite, and other naturally-occurring salts including trona, nacolite, borite and phosphates.

Liquids or gasses commonly reside in the void spaces of these bulk materials or are adsorbed on the surfaces of the materials or absorbed within the pores or capillary spaces of these bulk materials. Any liquids present are typically water or organic chemicals associated with the bulk materials. The transformative processing disclosed herein forces these gas and liquid materials from the bulk materials as the interstitial or porous spaces in the materials are destroyed.

The bulk materials may optionally be prepared for the initial compaction stage by processes designed to size the bulk particles to a size acceptable as a feed to the compaction machinery. Typically, the bulk materials are reduced in size by processes such as pulverization, crushing, comminution or the like to a suitable feed size and passed to a collection device or vessel where they can be stored or fed at a controlled rate to the compaction machinery. A similar rate control apparatus may be used to house the bulk materials before they are fed to an initial comminution device to produce the desired average feed particle top size. This bulk material may then be subjected to the first compaction step of the transformation processes of the invention. In a preferred embodiment, the bulk materials are comminuted to a particle size distribution of a top size of at least about 0.006 inch, but less than about 1 inch. Preferably, the average particle top size of the bulk material is reduced to about 0.04 inch prior to passing the bulk material to a holding or rate control apparatus and before passing the bulk material to the first stage compaction step.

The initial process in the transformation of the bulk materials is compaction of the materials at high pressure. The compaction preferably removes void spaces within the particles of the bulk material. The compaction pressure applied must be sufficient to reduce or destroy at least a portion of any void spaces present in the bulk materials. Typically, the bulk material is compacted under a pressure of at least about 3000 psi. The bulk materials may be compacted at much higher pressures including as high as 80,000 psi or higher. Preferably, the compaction pressures are between about 20,000 psi and about 60,000 psi. More preferably, the compaction pressures are between about 30,000 psi and about 50,000 psi. Even more preferably, the compaction pressure applied to the bulk materials is about 40,000 psi.

The bulk materials are preferably compacted at ambient temperature although cold or even partially frozen materials may be successfully processed. If there is a liquid absorbed within or adsorbed to the bulk materials, the materials should be warm enough to drive the liquid from void spaces in the material and this is most efficient if the temperature of the compacted materials is sufficiently high to keep the liquids from freezing. Similarly, the products may be warmed or hot at the time of compaction although little transformative effect is gained by providing heated materials to the compaction step. Most preferably, the bulk materials are compacted at an ambient temperature at which any liquids present in the void spaces remain in a liquid or gaseous state thereby facilitating their removal from the bulk materials.

The compaction pressure is applied to the bulk materials for the time necessary to transform the feed. Typically, the compaction pressure is applied for a period of at least 0.001 seconds. The compaction pressure may be applied to the bulk material for as long as about 10 seconds or longer. Preferably the compaction pressure is applied for a time period between about 0.1 seconds and about 1 second.

In one embodiment, the compaction is carried out by feeding the bulk material through two counter-rotating rolls in proximity to one another so as to provide the appropriate compaction pressure to the bulk material. The two counter-rotating rolls apply mechanical compaction forces to the bulk feed material by compacting the material between a specified gap between the rolls with a force that is sufficient to transform the feed material, while allowing liquids and/or gases within the feed material to be separated from the compacted product as void spaces occurring in the material are eliminated. The counter rotating rolls used preferably provide a compaction pressure to the bulk material of at least 3000 psi and more preferably the rolls are adjustable within the range of about 3000 psi and about 80,000 psi as described above. As the bulk materials are compacted between the counter-rotating rolls, the rolls may be cleaned with companion rollers, squeegees, blades or the like to draw away liquids or debris such as roll scrapings separated from the bulk materials by the application of the compacting pressure. The two counter-rotating rolls providing the compaction pressure to the bulk materials may be driven by a suitable reducer and electric motor at a circumferential speed that provides the desired process capacity and material residence time within the compression zone. In one embodiment, the relative rotation rate of the compaction rolls may be unity. Alternatively, the compaction rolls may be rotated asynchronously to provide a shearing force as well as compaction force to the bulk material. In this instance, the additional shearing force combined with the high pressure compaction forces may further reduce the void spaces in the bulk material.

The compacted materials, or compacts, exit the first compaction step in a compressed form that has fewer or lower void space compared to the bulk material applied to the compaction step. In the instance in which the compaction processes is performed using two counter-rotating rolls, the compacts exit the compacting rolls as a ribbon that will subsequently break into compacted pieces of bulk material that typically have a top size between about 0.5 inch and about 10 inches.

The compacted products exiting the compaction process are then comminuted. Preferably, the comminution is sufficient to reduce the particle size of the material. Any suitable means of breaking up or crushing the compacted products to reduce the particle size is useful at this stage of the transformation process. Comminution in its broadest sense is the mechanical process of reducing the size of particles or aggregates and embraces a wide variety of operations including cutting, chopping, grinding, crushing, milling, micronizing and trituration. For the purposes of the present disclosure, comminution may be either a single or multistage process by which material particles are reduced through mechanical means from random sizes to a desired size required for the intended purpose. Materials are often comminuted to improve flow properties and compressibility as the flow properties and compressibility of materials are influenced significantly by particle size or surface area of the particle.

Preferably, a comminution technique is used that is capable of processing the compacted products at a feed capacity equal to, or greater than, the rate at which compacted materials are being continuously produced from the compactor. If comminuting machinery incapable of this processing speed is used, a suitable means of collecting the compacted products and regulating their feed rate into the comminuting machinery may be used. It should be noted that if counter-rotating rolls are used to compact the bulk materials as described above, the rate of compaction can be modified by adjusting the rotation rate of the rolls. Preferably, the type of comminution process used is chosen to produce a product of a particle size distribution best suited for compaction and transformation.

The compacted bulk materials are comminuted to an average particle top size of at least about 0.006 inch. The average particle top size is preferably less than about 1 inch. The average particle top size of the bulk material is more preferably reduced to about 0.04 inch in this comminution step prior to passing the bulk material onto further processing. The bulk materials that have been compacted and comminuted in the processes of the present invention have more desirable physical characteristics than the starting materials including, greater particle density, lower equilibrium moisture content, lower water permeability, lower gas permeability, lower porosity, lower friability index and lower gas content than the bulk starting materials. In the instance in which low rank coals are subjected to the transformation processes of the present invention, in addition to the desirable physical characteristics listed above, the compacted and comminuted coal products may also have a higher heating value, lower carbon dioxide content, lower soluble ash content and lower sulfur content than the LRC feed material. Additionally, the compacted and comminuted coal products may be added to water to form a slurry that has a greater heating value than a similar slurry formed from the LRC feed material.

Following comminution the comminuted products may be stored, subject to air or evaporative drying, pneumatically transferred to a cyclone, bag house, or similar gas/solids separator for further separation of gasses and vapors, subjected to additional compaction designed to remove liquids that may remain in the comminuted products or further processed for specialized commercial uses. The comminuted products may also be subject to additional cycles of compaction and comminution. Each succeeding round of compaction and comminution further transforms the bulk materials by removing more void space from the transformed materials.

In one embodiment, the comminuted products are subjected to further compaction configured to reduce the presence of liquids remaining in the comminuted products. Considerable liquid may reside on or near the surface of the comminuted material following a cycle of compaction and comminution. The use of additional absorptive machinery further separates this liquid from the solids using high pressures. This optional absorptive step may be performed using a second, absorptive compaction step in which the transformed bulk materials are compacted again using machinery designed to absorb liquids present in the transformed materials. This is preformed by applying a compaction pressure of at least about 3,000 psi. Preferably, the comminuted products undergoing this absorptive compaction are subjected to compaction pressures between about 5,000 psi and about 15,000 psi. Preferably, some or all of the liquids residing in the comminuted products are removed through the use of porous compaction machinery that will absorb liquids from the compacted materials and carry the liquids away from the materials. For example, another set of counter-rotating rolls composed of porous materials that allow liquids residing on the surface of the feed material to be separated from the solids may be used in this optional absorptive compaction step. The porous material of these rolls may contain a sintered metal that has low permeability and a mean pore size of less than about 2 microns. Alternatively, the porous material of these pores may be porous ceramic having a low permeability and a mean pore size of less than about 2 microns. Liquids present in the transformed materials are forced from the materials and driven into the pores of the rolls at a rate sufficient to produce a satisfactory product.

Figure 2:
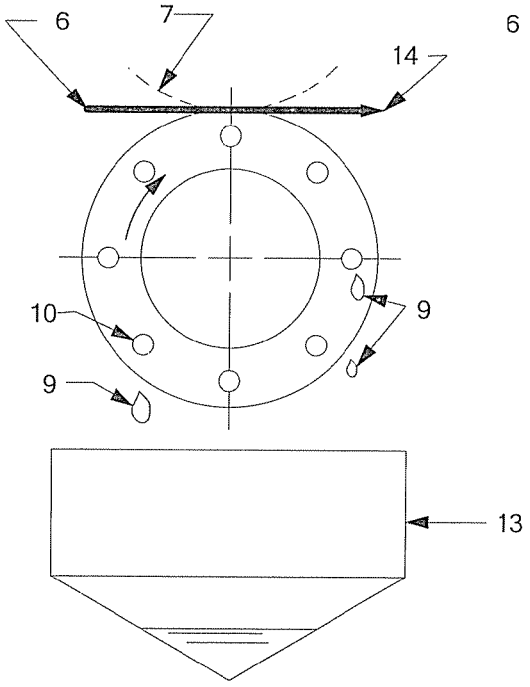
FIG. 2 shows an elevation at section A-A of the roll of FIG. 2.
Figure 3:
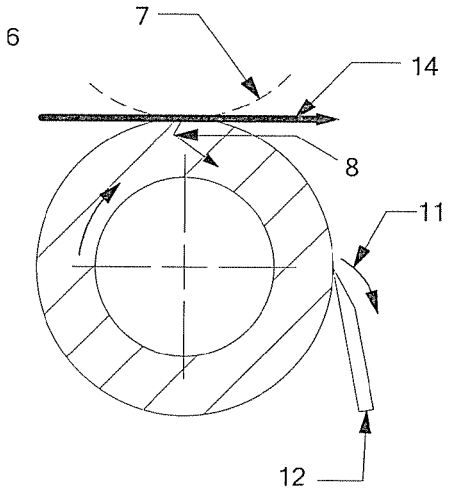
FIG. 3 shows an elevation at section B-B of the roll of FIG. 2.

FIG. 1 shows a schematic drawing of a plan view of a single preferred absorber roll used in the absorptive counter-rotating roll assembly that may optionally be applied to the transformed products to pull liquids away from these materials. FIGS. 2 and 3 show two sectional elevations taken at sections A-A and B-B of the roll of FIG. 1, respectively. Referring to FIG. 1, the absorber roll unit consists of a central shaft (2) that is supported by bearings (3), end pieces (4) and liquid receptors (5). The receptors (5) are thin, ring-shaped pieces of material such as porous sintered metal or ceramic of a small pore opening and low permeability to provide a durable item that can withstand great mechanical stress, yet allow liquid/solid separation to take place under high pressure. These rings can be readily placed on the central shaft (2) to provide a unique roll configuration that suits the absorptive application of these compaction rolls. Damaged rings may therefore be removed and replaced without overhauling the entire roll assembly.

Referring to FIGS. 2 and 3, the comminuted feed material (6) is diagrammatically shown entering under mechanical pressure from the left and exiting the right side of the horizontal roll assembly. Other orientations of feed entry are possible without consequence to the liquid/solid separation phenomena.

Companion rolls (7) identical in configuration to the roll assembly (1) described above are held in proximity to these rolls along a plane parallel to the axis of rotation. The rolls are propelled by a mechanical drive system of standard design to provide counter rotating motion. Mechanical means exert a specified force on the bearings (3) to maintain the gap between the rolls, thus providing the pressure to force liquid held on the comminuted feed material into the receptors. Liquid contained on the surface of the comminuted feed material (6) is compacted between the roll assembly (1) and companion roll (7). A portion of the liquid is absorbed under pressure by the receptors (5) as the comminuted feed is engaged by the rolls. Liquid absorbed by the receptors (5) migrates from the surface (8) of the receptors (5) and, after the receptors become saturated, flows (9) through numerous weep holes (10) in either of the end pieces (4). Liquid remaining on the surface (8) of the receptors (5) is collected and removed (11) from the roll assembly (1) by scraper blade (12). The collected and removed liquid (11) may be collected in a container (13) for disposal or further processing. In the instance in which LRCs are processed through the transformation methods of the present invention, the liquid recovered from this absorptive compaction processing will be primarily water and the water collected and recovered will be sufficiently clean for use in further industrial processes without additional purification. Unlike low-pressure roll devices, re-absorption of liquid into the product material is not of significance because the interstitial, capillary, pores, and other voids are largely absent due to the previous compaction. Compressed material (14) having a reduced liquid content exits this absorptive roll assembly for further processing.

Similar to the compacted products exiting the first, high-pressure compaction step, the compacts exiting this absorptive compaction step have a pressed form that has lower void space compared to the bulk material applied to this absorptive compaction step. Particularly, these compacts have a lower liquid and/or gas content than the bulk materials applied to the absorptive rollers. These compacts also exit the absorptive rollers in a compacted ribbon that subsequently breaks into compacts.

Similar to the post-compaction and comminution processing procedures described above, transformed materials processed through this optional absorptive compaction step may undergo additional processing including storage, air or evaporative drying, transfer to a bag house for further separation of gasses or further processed in preparation for specialized commercial uses. These bulk materials may also be fed to additional cycles of compaction and comminution to more extensively remove void space from the materials.

Figure 4:
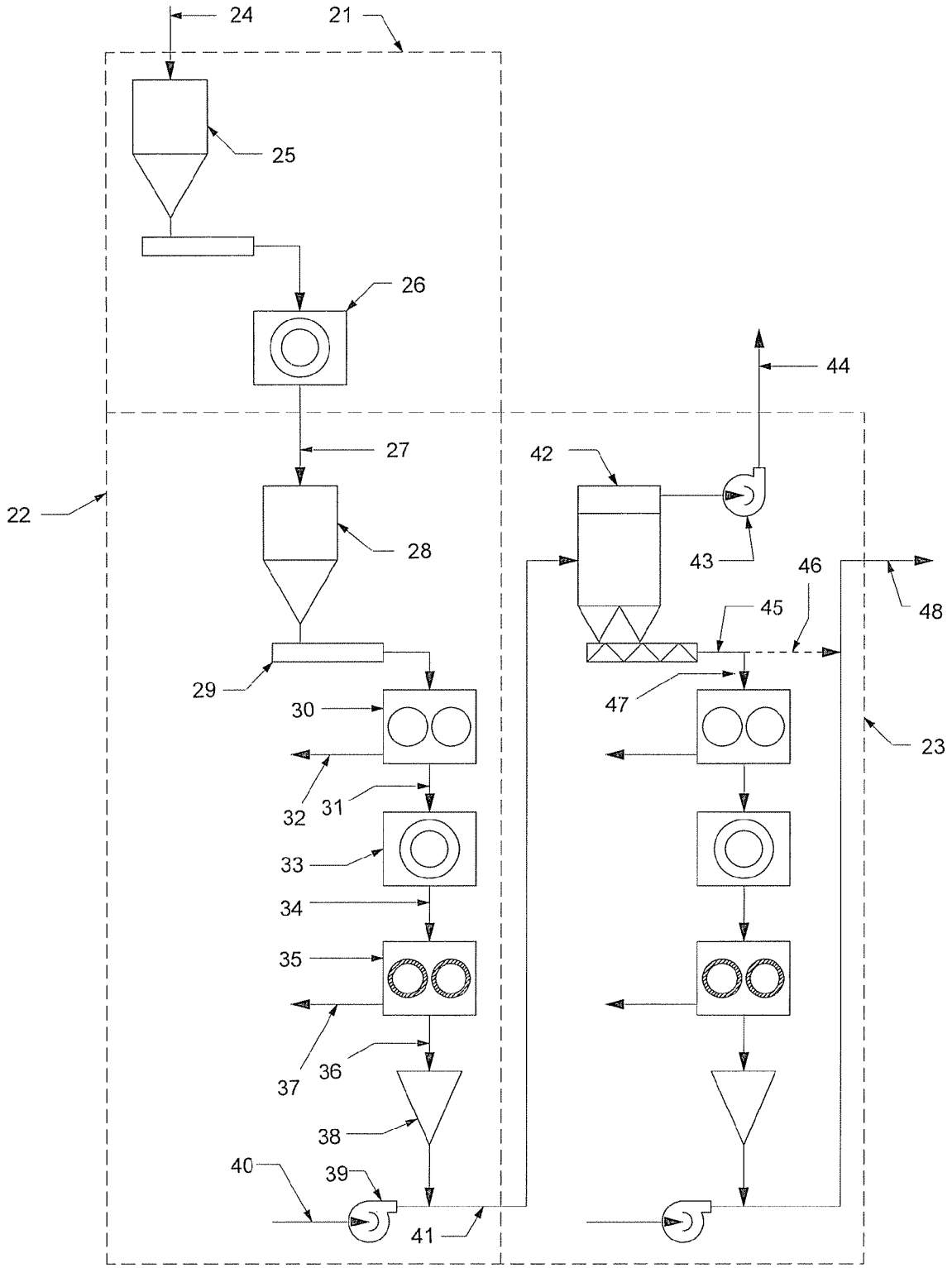
FIG. 4 shows a schematic diagram of processing procedures of the present invention.

FIG. 4 shows a schematic representation of a preferred embodiment of these transformation processes applied to bulk materials, as well as machinery used in these processes. Referring to FIG. 4, the feed preparation unit (21) accepts a bulk feed material (24) in a surge bin and feeder (25). A measured rate of material is reclaimed from the surge bin and crushed in comminution machinery (26) to the desired top size. Comminuted material (27) passes from the feed preparation unit to the first-stage compaction/crushing unit (22).

In the first-stage compaction/crushing unit (22), comminuted feed (27) is stored in a surge bin (28) and fed by a gravimetric feeder (29) at a controlled rate to the primary double-roll compaction machine (30). The machine produces primary compacted feed (31) and roll scrapings (32). The primary compacted product is crushed in comminution machinery (33). Comminuted product (34) is fed to an optional secondary double-roll absorption machine (35). The machine produces first-stage compacted product (36) and liquids (37) absorbed from the comminuted product (34). The first-stage compacted product (36) is collected in surge bin (38) where it is prepared for pneumatic transport. Atmospheric air (40) is pressurized by fan (39) to engage the prepared first-stage product to form a mixture (41) suitable for transport to a baghouse (42).

Fabric filters included in the baghouse (42) separate solids from vapor. An induced-draft fan (43) draws vapors (44) from the baghouse and discharges the gas to the atmosphere. Solids reclaimed by the baghouse (45) may optionally be directed to bypass further processing (46), or to additional processing (47) in a second compaction/crushing stage unit (23).

The second-stage compaction/crushing unit (23) is essentially identical to the first-stage compaction/crushing unit (22). Similar equipment includes the primary double-roll compaction machine, comminution machinery, optional secondary double-roll absorption machine, surge bin, and fan. Finished product (48) can pass to a final product collection device or to additional compaction/crushing stages. Additional rounds of compaction and comminution may be applied to the products (48) depending on the desired characteristics of final product. Deployment of the equipment needed to effect the transformative changes disclosed herein may be carried out rapidly and efficiently through the assembly and modification of commercially available equipment. Further processing may also include agglomeration and preparation for specific commercial uses.

Post-processing procedures may be applied to the transformed materials. These post-processing procedures are for the benefit of the mining, transportation or consumer industries. Any of these industries may benefit from the transformation of the bulk materials by realizing lower costs as estimated capital and operating costs may be less than 20% of bulk materials subjected to alternative thermal drying systems. Similarly, electricity inputs are estimated to be less than 20% of flue gas, steam, hot oil, and the like, used in some thermal processing options. With respect to the processing of LRCs using the processing technologies of the present disclosure, the heat value of the transformed products may exceed 10,000 Btu/lb, while the removal of some of the sulfur, sodium, oxygen, carbon dioxide and nitrogen emissions from the burning of the transformed coal may mitigate the production of greenhouse gas emissions. Additionally, with respect to dust control measures, the compaction procedures disclosed herein will mitigate most windage losses during handling and transportation of the transformed materials. Also, the potential for spontaneous combustion resulting from rehydration is minimized when internal voids are destroyed by compaction.

Another embodiment is the compacted product resulting from the application of the methods disclosed herein to bulk materials. These compacted materials can have many desirable physical characteristics for industrial use including a low equilibrium moisture content (EMQ). Thus, these compacted materials can have a very low level of rehydration. Typically, the EMQ of these compacted materials is less than about 26%. Preferably, the EMQ of these compacted materials is less than about 20% and more preferably less than about 15% and more preferably, less than about 10%. Typically, the EMQ of the compacted materials is between about 10% and about 25%. For some compacted materials, an EMQ of less than about 25% represents a significant and advantageous decrease in the EMQ of the starting bulk material, prior to processing according to the methodology of the present invention. Thus, using the techniques described herein, it is possible to reduce the EMQ of the starting material by at least about 5%. Typically, the EMQ of the starting bulk material is reduced by between about 5% to about 70% with successive rounds of compaction and comminution as disclosed herein. Preferably, the EMQ of the compacted material is reduced by about 10% compared to the EMQ of the non-compacted, starting materials. More preferably, the EMQ of the compacted material is reduced by about 20% compared to the EMQ of the starting (non-compacted) materials, and more preferably, the EMQ of the compacted material is reduced by about 30% compared to the EMQ of the starting materials, and more preferably, the EMQ of the compacted material is reduced by about 40% compared to the EMQ of the starting materials, and more preferably, the EMQ of the compacted material is reduced by about 50% compared to the EMQ of the starting materials and more preferably, the EMQ of the compacted material is reduced by about 60% compared to the EMQ of the starting materials.

Additional objects, advantages, and novel features of this invention will become apparent to those skilled in the art upon examination of the following examples thereof, which are not intended to be limiting.

EXAMPLES

Example 1

A detailed study of two bulk materials (high-moisture lignite from South Australia and brown coal from Victoria, Australia) was undertaken to assess the effects of particle size, washing and leaching, additives, agglomeration, briquetting, slurrying, rehydration, autoclaving, and the application of thermal energy and pressure, as effective methods of transforming or beneficiating low rank coal (LRC) to provide a more useful, cost effective, clean fuel. The test program revealed comminution to a specific particle size range and compaction, configured in the continuous mode of the present invention to be the most beneficial factors in the mechanical transformation of LRC into a high quality fuel.

Published reports (Anagnostolpoulos, A., *Compressibility Behaviour of Soft Lignite*, J. Geotechnical Engineering 108 (12): (1982); and Durie, R. *Science of Victorian Brown Coal: Structure, Properties and Consequences of Utilisation*, CSIRO, Sydney, Australia (1991)) dealing with similar LRCs showed that some moisture can be removed when low pressures in the range of 1400 psi to 2300 psi are applied to the material over several days at ambient temperatures. Similarly, low pressures of about 500 psi have been used in combination with thermal processing in several prototype beneficiation systems (McIntosh, M. *Pre-drying of High Moisture Content Australian Brown Coal for Power Generation,* 22$^{nd}$ Annual International Coal Preparation Conference, Lexington, Ky. (2005); and Van Zyl, R. *History and Description of the KFx Pre-Combustion Coal Process,* 22$^{nd}$ Annual International Coal Preparation Conference, Lexington, Ky. (2005)).

The present inventors' research shows that low-pressure compaction does not permanently transform the physical characteristics of these bulk materials.

Example 2

Various LRC samples were processed using the procedures and equipment diagramed in FIG. 1 and described above. The effects of these mechanical transformation processes and the quality of the finished compacted products were evaluated.

To evaluate the transformative effects and the quality of the finished products, the equilibrium moisture content (EQM) of LRC feeds and products was measured. The EQM is defined by the American Society of Testing and Materials (ASTM) procedure ASTM D-1412. The EQM is the moisture content held by coal stored at a prescribed temperature of 30° C. under an atmosphere maintained at between 96% and 97% relative humidity. Under these conditions, moisture is not visible on the surface of the coal, but is held in the capillary, pores, or other voids. Coals with low EQM contain less capillary, pores, or other void volume to hold water. These coals have typically more useful thermal energy than coals with higher EQM, and are subsequently more valuable as feedstock for energy generation processes. Table 1 shows the results of EQM testing conducted on samples of subbituminous coal supplied from the Power River Basin, Wyo., USA and lignite from North Dakota, USA, prior to, and after five successive stages of compaction/comminution. In each cycle of compaction/comminution, a compaction pressure of about 30,000 psi was applied at ambient temperature for less than 1 second.

TABLE 1

Equilibrium Moisture Contents of Raw Feed and Compacted Products

| Material | Subbituminous Coal (Powder River Basin) | Lignite (North Dakota) |
|---|---|---|
| Unprocessed Feed | 27.0% | 32.4% |
| 1$^{st}$ Stage Compaction/ Comminution Product | 16.4% | 26.2% |
| 2$^{nd}$-Stage Compaction/ Comminution Product | 15.7% | 23.6% |
| 3$^{rd}$-Stage Compaction/ Comminution Product | 14.3% | 21.9% |
| 4$^{th}$-Stage Compaction/ Comminution Product | 12.9% | 20.0% |
| 5$^{th}$-Stage Compaction/ Comminution Product | 11.9% | 18.6% |

These data show that compaction and comminution of LRC bulk materials using the processes of the present invention can significantly reduce the EQM of the bulk materials and that, with each successive round of compaction and comminution, the EQM is reduced. Additionally, these data demonstrate the ability to reduce the EQM of bulk materials by 20-40% after only one round of compaction and comminution, while the EQM can be lowered by 40-60%, or more, with subsequent rounds of compaction and comminution.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiment described hereinabove is further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method of removing water residing in internal void space of a carbonaceous material comprising:

crushing a carbonaceous material to form a crushed material of reduced particle size; and compacting the crushed material by subjecting the crushed material to a pressure of at least about 3000 psi in a counter-rotating roll compaction machine to compress and destroy void space in the crushed material, forcing water in the void space to the surface of the material, to form a ribbon.

2. The method of claim 1, wherein the carbonaceous material is selected from the group consisting of bituminous coal, peat, low-rank coal, brown coal, lignite, subbituminous coal, coke, and combinations thereof.

3. The method of claim 1, further comprising drying the ribbon to remove the water at the surface of the compact to form a dried carbonaceous ribbon.

4. The method of claim 1, wherein the crushed material is compacted for between about 0.001 seconds and about 10 seconds.

5. The method of claim 3, further comprising:

compacting the dried carbonaceous ribbon in a counter-rotating roll compaction machine to produce a dried ribbon.

6. The method of claim 3, further comprising:

compacting the dried granular product in a counter-rotating roll compaction machine to produce a dried compact material comminuting the dried compacted ribbon to form a dried comminuted ribbon;

compacting the dried comminuted ribbon in counter-rotating rolls to produce a final product.

7. A method of removing void spaces and vapors present in carbonaceous materials comprising:

comminuting a carbonaceous material, wherein the comminuting the carbonaceous material reduces a size of the carbonaceous material, wherein the comminuting step is a process selected from the group consisting of cutting, chopping, grinding, crushing, milling, micronizing, trituration and a combination thereof to form a crushed material; and, compacting the crushed material in a counter-rotating roll compaction machine to produce a compact having reduced interstitial voids and gases, wherein the counter-rotating rolls provide a compaction pressure to the crushed material of between about 3,000 psi and about 80,000 psi; and, separating vapors from the compact in a gas/solids separator to form a dried carbonaceous product.

8. The method of claim 7, wherein the crushed material is fed at a controlled rate to the step of compacting.

9. The method of claim 7, wherein the step of compacting comprises subjecting the crushed material to a pressure between about 20,000 psi and about 60,000 psi.

10. The method of claim 7, wherein the step of compacting comprises subjecting the crushed material to a pressure between about 30,000 psi and about 50,000 psi.

11. The method of claim 7, wherein the step of compacting comprises subjecting the crushed material to a pressure of about 40,000 psi.

12. The method of claim 7, wherein the step of compacting is conducted at a temperature at which any liquids present in void spaces in the crushed material remain in a liquid or gaseous state.

13. The method of claim 7, wherein the crushed material is compacted for between about 0.001 seconds and about 10 seconds.

14. The method of claim 7, wherein the crushed material is compacted for between about 0.1 seconds and about 1 second.

15. The method of claim 7, wherein the step of compacting comprises feeding the crushed material between two counter-rotating rolls.

16. The method of claim 15, wherein at least one of a liquid and a gas is forced from a void space in the crushed material during the compacting.

17. The method of claim 15, further comprising cleaning the counter-rotating rolls with at least one of a companion roller, a squeegee and a blade.

18. The method of claim 15, wherein the counter-rotating rolls are driven by a reducer and an electric motor to provide a crushed material residence time within the compression zone of between about 0.001 seconds and about 10 seconds.

19. The method of claim 15, wherein the compact exits the counter-rotating rolls as a ribbon.

20. The method of claim 7, wherein the compact is comminuted to an average particle top size between about 0.006 inch and about 1 inch.

* * * * *